United States Patent [19]

Goldbarg

[11] 4,279,437

[45] Jul. 21, 1981

[54] REFUSE COLLECTING TOOL

[76] Inventor: Herman Goldbarg, 1857 Beechwood, St. Paul, Minn. 55116

[21] Appl. No.: 823,604

[22] Filed: Aug. 11, 1977

[51] Int. Cl.[3] ..... A47F 13/06

[52] U.S. Cl. ..... 294/1 BB

[58] Field of Search ..... 294/19 R, 1 R, 25, 55, 294/52; 15/257.7, 257.9; 224/26 R, 26 G, 26 K

[56] References Cited

U.S. PATENT DOCUMENTS

| | | | |
|---|---|---|---|
| 3,659,891 | 5/1972 | Pettenon et al. | 294/19 R |
| 3,910,619 | 10/1975 | Schmieler | 294/19 R |
| 3,986,744 | 10/1976 | Krogstad et al. | 294/1 R |
| 4,019,768 | 4/1977 | Niece | 294/19 R |

*Primary Examiner*—James B. Marbert

*Attorney, Agent, or Firm*—Robert C. Baker

[57] ABSTRACT

The tool for collecting refuse comprises an orifice structure having a collector span as a part thereof, plus an elongated handle member extending outwardly from the orifice structure opposite the collector span. The collector span consists essentially of a multiplicity of substantially parallel spaced stretches of wire. Connecting means between the substantially parallel stretches hold them in their parallel condition without the connecting means presenting an obstruction to sliding movement of refuse through the orifice structure on the upper planar surface of the parallel stretches and off the trailing exit edges thereof. The connecting means includes offset interconnections at least between different pairs of adjacent parallel stretches at a location proximate to the exit side of the orifice structure. The offset interconnections serve as abutment means for retaining the throat of a refuse receiving bag about the orifice structure at its exit side.

8 Claims, 3 Drawing Figures

REFUSE COLLECTING TOOL

This invention relates to a novel tool for collecting refuse. The tool is especially useful for collecting solid fecal matter of household pets from lawns.

Removal of solid fecal matter from lawns and other outside ground or base surfaces may indeed be accomplished by a variety of methods using heretofore known tools or implements, including the common scoop or shovel. But all known tools heretofore employed for this purpose tend to become extremely messy during the operation and make the job distasteful.

The tool of this invention is unique in that it permits the removal and collection of solid fecal refuse with a minimum of mess or contamination of the tool itself, and with a speed and effectiveness heretofore not reasonably believed to be possible.

The collector span of the tool of this invention is easily slipped under solid fecal refuse and provides minimum contact with the solid refuse. Additionally, the collector span presents no significant obstruction to sliding movement of refuse on the refuse gathering surface of it and off the exit edge of that surface into a refuse receiving or collection bag. The minimum supporting contact for the solid fecal refuse as it slides upon the upper refuse gathering surface of the collector span of this tool presents a unique deviation from the concepts heretofore employed for refuse collecting tools.

The following seven U.S. Pat. Nos. set forth the prior art which is known: Reddick U.S. Pat. No. 226,351; Fisher U.S. Pat. No. 3,281,178; Pettenon et al. U.S. Pat. No. 3,659,891; Hamilton U.S. Pat. No. 3,688,483; Hufnagel U.S. Pat. No. 3,937,509; Casci U.S. Pat. No. 3,977,715; Krogstad et al. U.S. Pat. No. 3,986,744. The shovel of U.S. Pat. No. 226,351 is of general interest; but the cross tie critically required for that shovel is contrary to the teaching of this invention. The bag of U.S. Pat. No. 3,281,178 also is of interest; but the required sealing of the collar portion thereof to the body portion thereof along two lines is contrary to this invention. Superficially, the structure shown in the drawing of U.S. Pat. No. 3,688,483 appears at first glance to be pertinent here; but upon close inspection, the device of that patent lacks not only the unique collector span of this invention but also the offset interconnections there required.

The tool of this invention comprises an orifice structure formed of frame means approximating an inverted U-shape in appearance and a collector span extending between the terminal ends of the two legs of the U-shape. An elongated handle member extends outwardly from the perimeter of the orifice structure opposite the collector span thereof. The orifice structure has an exit side opposite the anterior entrance side thereof. It has an abutment means for retaining the throat of a refuse receiving bag about it with the throat anterior to the exit side of the orifice structure as refuse is collected using the tool.

Further, the orifice structure of this tool is characterized in that its collector span consists essentially of a multiplicity of substantially parallel spaced stretches of wire arranged in series between the terminal ends of the two legs of the frame means. These parallel stretches lie in a plane transverse to those two legs. Thus, the parallel stretches form an upper planar refuse gathering surface facing inside the orifice structure. Each parallel stretch has a leading end and a trailing end. The trailing ends from the exit edge of the refuse gathering surface of the orifice structure.

Other features of this collector span are as follows: Connecting means hold the parallel stretches of wire in parallel condition, without the connecting means presenting an obstruction to sliding movement of refuse through the orifice structure on the refuse gathering surface and off the exit edge of that surface. The connecting means includes offset interconnections between at least different pairs of adjacent parallel stretches of the wire at a location proximate to the exit side of the orifice structure. The offset interconnections are outwardly disposed from the refuse gathering surface and serve as the aforesaid abutment means for retaining a refuse gathering bag on the orifice structure during refuse collection.

In its most preferred configuration, the collector span consists essentially of a single length of wire looped back and forth to form a multiplicity of substantially parallel spaced stretches thereof arranged in the aforenoted series between the terminal ends of the two legs of the frame means. The loops connecting pairs of adjacent parallel stretches of the wire at the leading ends thereof serve as blunt projections not likely to pierce refuse.

The preferred refuse receiving bag affixed to the tool of this invention and comprising a part of it as to affixed includes a neck (or collar) portion extending from the throat of the bag to the mouth opening of the bag. In other words, the throat of the bag is intermediate its mouth opening and the bottom or sealed end of the bag. As affixed to the tool, the neck portion of the bag is folded back outside the bag to extend as a skirt from the throat. This skirt serves to protect the outer surface of the bag below the throat from refuse contact as refuse is collected using the tool. The skirt is free of seal attachment to portions of the bag below the throat thereof, and is easily pulled out to an unfolded condition on removal of the bag from the orifice structure of the tool. By unfolding and pulling out the skirt, refuse contamination on the skirt is placed on the inside of the bag before closing the mouth of the bag for disposal.

Additional benefits and features of the invention will be described with the aid of a drawing, made a part hereof, wherein.

Figure 1:
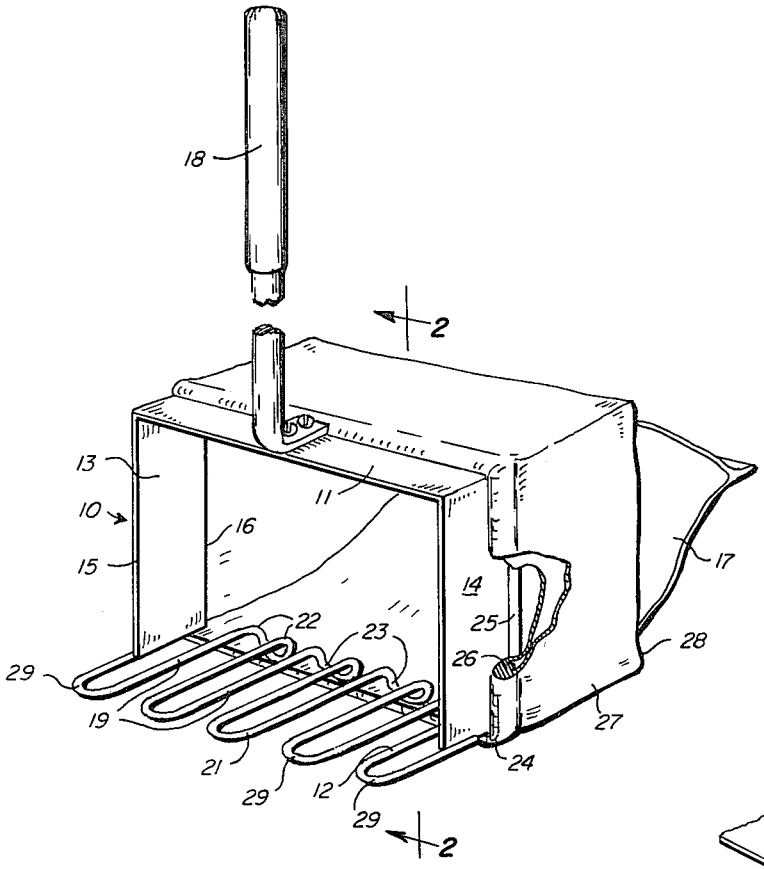
FIG. 1 is a schematic perspective view, partially broken away, of the new tool, including a refuse receiving bag as a part thereof.

Referring to the drawing, the tool comprises an orifice structure 10 which is defined by, and in fact formed by, a frame means 11 approximating an inverted U-shape in appearance, plus a collector span 12 extending between the terminal ends or lower ends of the two legs 13, 14 of the U-shape. This orifice structure has an anterior entrance side 15 opposite its exit side 16. The exit side 16 is the side to which a bag 17 is affixed. All fecal matter going into the bag 17 passes through the orifice 10 as the tool is used for collecting purposes.

An elongated handle member 18 extends outwardly from the perimeter of the orifice structure opposite the collector span 12 thereof. The handle may be affixed by bolts or the like to the yoke or upper portion of the U-shaped frame. Optionally, the handle may be conveniently detachable from the frame, or collapsible by telescoping or the like, to reduce the size of the total device for storage purposes. The total length of the elongated handle suitably approximates that of the shaft of a golf club.

The orientation of the orifice structure 10 with respect to the elongated handle means 18 should be noted to be such that the passage or opening through the orifice structure 10 is transverse to the extension or projection of the elongated handle 18.

The collector span portion 12 of the orifice structure 10 may assume various details of specific configuration, but it specifically and critically must consist essentially of a multiplicity of substantially parallel spaced stretches 19 of wire arranged in series between the terminal ends of the two legs 13, 14 of the U-shaped frame. The substantially parallel spaced stretches 19 or lengths of wire are all in a plane transverse to the length of the legs 13, 14. They are also in a plane transverse to the elongated handle 18. The arrangement of the parallel stretches 19 of wire is such that they form a planar upper refuse gathering surface 20 (see FIG. 2) which faces inside the orifice structure itself. Each parallel stretch 19 has a leading end (illustratively marked at its terminus by the numeral 21 in FIG. 1) and a trailing end (marked at its terminus by numeral 22 in FIG. 1). To be also recognized is the fact that connections exist between adjacent parallel stretches of wire; and such connections are truly critical at or near or proximate to the trailing end portions of the wire. They are optional but much preferred at the leading or anterior end of the parallel stretches.

The trailing ends of these parallel stretches form what is called an "exit edge" 22 of the refuse gathering surface 20 of the orifice structure. The refuse gathering surface, of course, is that surface formed by the upper surface of the parallel stretches 19 per se. Ideally, the parallel stretches are as truly parallel with each other as reasonably possible; but the benefits of this invention, in terms of sliding movement of refuse over the surface 20, are still substantially retained even when the spaced stretches or lengths 19 of wire are not precisely parallel but are at least substantially parallel.

In order to maintain the substantially parallel stretches of wire in their parallel condition, a connecting means between them is required. It is critical that the connecting means must present no significant obstruction to the sliding movement of refuse through the orifice structure on the refuse gathering surface 20 of it. Further, these connections should not interfere with, nor present a significant obstruction to, sliding movement of refuse off the exit edge 22 of the refuse gathering surface 20. These features are most important because they enable the tool of the invention to be employed for refuse pick up, especially solid fecal pick up, without significant restriction to the sliding movement of the refuse entirely through the orifice structure 10 into the bag 17, and without significant contamination of the orifice structure per se. The parallel stretches 19 of wire truly provide a degree of support for solid fecal matter in its movement, but do not significantly offer resistance to sliding movement of it over the refuse gathering surface 20 into the collecting bag 17.

In all instances, the connecting means for holding the parallel stretches of wire in parallel condition includes offset interconnections 23 between at least different pairs of adjacent parallel stretches 19 of the wire. The offset interconnections which must be present are at a location proximate to the exit side 16 of the orifice structure. They are therefore proximate to the exit edge 22 of the refuse gathering surface 20. These offset interconnections 23 are outwardly disposed with respect to the refuse gathering surface 20. They depend below it or downwardly from the refuse gathering surface 20. If desired, connections solely at the exit side, and offset as described, may be used to hold the parallel stretches in position.

The downwardly disposed offset interconnections 23 at or proximate to the exit side of the orifice structure serve as an abutment means at the collector span portion 12 of the orifice structure. The abutment means 23 provides a means for retaining the throat 24 of a refuse receiving bag 17 at the exit side 16 of the orifice structure.

Figure 3:
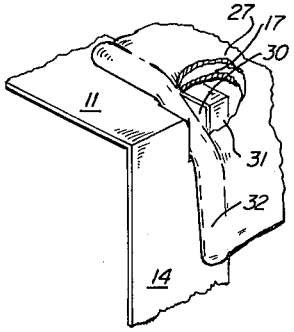
FIG. 3 is a fragmentary schematic perspective view, with parts broken away, illustrating one type of frame abutment structure.

In the preferred tool, the abutment means 23 for retaining the bag 17 off the exit side of the orifice structure is more extensive than that formed solely by the offset interconnections at the collector span 12. However, greatest need for the abutment means on the orifice structure exists at the collector span portion 12. It is there that the normal motion of the tool for collecting refuse, and the rubbing of that collector span 12 on or near the ground, tends to push the throat 24 of the collecting bag 17 toward or off the rear or exit side of the orifice. Further contributing to retention of the bag 17 on the orifice structure during refuse collection is an optional but much preferred extension of some sort of abutment means or elements on the U-shaped frame 11. Illustratively, the exit side 16 of the U-shaped frame is suitably provided with outwardly disposed flange means 25. The flange may be intermittently spaced about the frame or continuous about it. When continuous, it contributes to structural strength for the U-shaped frame and permits relatively thinner and therefore weaker materials to be used in fabricating the frame. The outwardly disposed flange means 25 may, for example, be formed as a bead outwardly about the exit portion 16 of the frame, or it may be formed by merely bending the edge of sheet material for the frame outwardly. Alternatively, abutment elements or means on the frame 11 may be formed by placing a recess or groove into the outer perimeter of the frame 11. The outer rear or exit side edges of the recess or groove serve as the optional frame abutment means. For example, as shown in FIG. 3, the corners of a squared frame (where such shape is used) may be cut into with a slot or recess 30, with the corner slot extending in the circumference direction about the orifice 10. The frame material 31 on the side of the slot nearest the exit side forms an edge against which the throat 32 of the collection bag abuts to stop it from being pulled off the exit side of the frame during fecal collection use of the tool.

Figure 2:
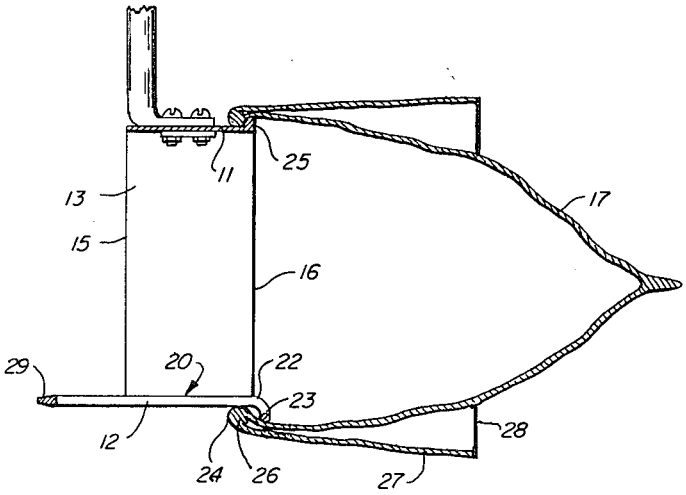
FIG. 2 is a cross sectional view of the tool, taken on line 2—2 of FIG. 1.

As illustrated in FIGS. 1 and 2, the throat 24 of the bag 17 is suitably equipped with an elastic member or an elasticized portion 26 (or optionally one may use an elastic band separate from the bag) which clings to the exterior surfaces of the orifice structure anteriorly to the abutment means. The key point is that a collector span abutment means 23 is required, and frame abutment means is desirable, for the function of retaining the throat 24 of the refuse receiving bag about the orifice structure as refuse is collected with the tool.

The ideal bags to employ as collection bags 17 are those which include a neck portion 27 extending from the throat portion 24 to the mouth opening 28 of the bag. The neck portion 27 of the bag, as illustrated in the drawing, is actually folded back outside the bag to extend as a skirt 27 from the throat portion 24 thereof. This skirt 27 serves to protect the outer surface of the bag below the throat area 24 (i.e., from the throat to the sealed bottom end of the bag) from refuse contact as refuse is collected with the tool. The skirt 27 is not sealed to any portion of the bag in its folded back condition. It is easily pulled out to an unfolded condition on removal of the bag from the orifice structure. By pulling it out to an unfolded condition, any refuse contamination of the skirt is turned inside the bag before the mouth 28 of the bag is closed for disposal. Preferably, the material out of which the bag is formed is an organic plastic, such as, for example, polyethylene.

In the most preferred embodiment of the invention, a single length of wire is looped back and forth in a serpentine manner to form the multiplicity of substantially parallel spaced stretches 19, with the ends of the wire fixed to the terminal ends of the frame legs 13, 14. Loops 29 connect pairs of adjacent parallel stretches of this wire at the leading ends thereof and serve as blunt projections not likely to pierce solid fecal refuse collected with the tool. Even when the wire of loops 29 is slightly flattened in the plane of said collector span, as is desirable for tools designed especially for pick up of solid fecal matter from cement surfaces such as sidewalks or roadways, they still provide a relatively blunt projection as compared to a projecting anterior end per se of wire. Flattened loops tapered toward the anterior entrance side are most effective for refuse collection from sidewalks. But it is the presence of anterior loops 29, with or without a taper, that is especially preferred, for they improve the efficacy of solid fecal collection with minimal contamination of the tool.

In use, the tool is gripped at its handle and swung so that the collector span passes under the solid fecal refuse. The inertia of the refuse relative to the movement of the collector span causes the solid fecal refuse to slide over the collector span and into the bag almost instantaneously, with minimal contact with the wire of the collector span and minimal contamination of it. An extremely rapid swing of the tool is neither desirable nor necessary to accomplish this feat. A normal smooth swing without exertion is all that is required.

Any suitable material may be employed in fabricating the tool. Metals or organic plastics are preferred materials out of which to fabricate the collector span and the U-shaped frame. The orifice structure may be made with great strength and high resistance to deformation under pressures or weight, or it may be fabricated out of materials which yield or exhibit slight and temporary "elastic" deformation in use (with recovery to the nondeformed condition relatively quickly after use). For example, the entire orifice structure may be formed out of polystyrene plastic, if desired. Such plastic may suffer slight and temporary deformation in use without significantly detracting from the operability of the tool for its intended purposes. Because the entire orifice structure, including the collector span, may be formed out of organic plastic material, it is emphasized that the term "wire" as used herein encompasses plastic as well as metallic wire.

That which is claimed is:

1. A tool for collecting refuse, consisting essentially of an orifice structure formed of frame means approximating an inverted U-shape in appearance and a collector span extending between the terminal ends of the two legs of said U-shape, and an elongated handle member extending outwardly from the perimeter of said orifice structure opposite said collector span thereof, said orifice structure having an exit side opposite the anterior entrance side thereof, an abutment means at said exit side for retaining the throat of a refuse receiving bag thereabout with said throat clinging anterior to and proximate to said exit side thereof as refuse is collected with said tool, and being further characterized in that said collector span thereof consists of a single length of wire looped back and forth to form a multiplicity of substantially parallel spaced stretches thereof arranged in series between said terminal ends of said two legs and lying in a plane transverse to said legs, whereby said parallel stretches form an upper planar refuse gathering surface facing inside said orifice structure, each said parallel stretch of wire having a leading end and a trailing end, said trailing ends forming the exit edge of said refuse gathering surface of said orifice structure, the loops connecting pairs of adjacent parallel stretches of said wire at said leading ends thereof serving as blunt projections not likely to pierce refuse, the loops connecting pairs of adjacent parallel stretches of said wire at said trailing ends thereof being outwardly disposed offset interconnections with respect to said refuse gathering surface, whereby said offset interconnections do not present an obstruction to sliding movement of refuse through said orifice structure on said refuse gathering surface and off said exit edge thereof, said offset interconnections serving as the aforesaid abutment means and being the means against which the lower span of the throat of a refuse receiving bag abuts and is held in position underneath the exit edge of said refuse gathering surface.

2. The tool of claim 1 wherein said abutment means on said orifice structure includes abutment elements on said frame means per se proximate to the exit side thereof.

3. The tool of claim 2 wherein said abutment elements of said frame means comprise flange means.

4. The tool of claim 2 wherein said frame means includes recess means into the outer perimeter of it, and wherein said frame abutment elements comprise edges of said recess means nearest said exit side of said frame means.

5. The tool of claim 1 additionally comprising a disposable refuse receiving bag having a throat which is attached to cling about said orifice structure anteriorly and against to said abutment means thereof.

6. The tool of claim 5 wherein said bag includes a neck portion extending from said throat thereof to a mouth opening thereof, and wherein said neck portion of said bag is folded back outside said bag to extend as a skirt from said throat portion, said skirt serving to protect the outer surface of said bag below said throat from refuse contact as refuse is collected with said tool, said skirt being free of seal attachment to portions of said bag below said throat and being easily pulled out to an unfolded condition on removal of said bag from said orifice structure, to thereby place any refuse contamination of said skirt on the inside of said bag before closing the mouth of said bag for disposal.

7. The tool of claim 6 wherein the material out of which said bag is formed comprises an organic plastic.

8. The tool of claim 1 wherein said connecting loops at said leading ends of said parallel stretches lie in substantially the same plane as said parallel stretches and are tapered toward said anterior entrance side of said orifice structure.

* * * * *